United States Patent [19]

Conybear et al.

[11] 4,191,598

[45] Mar. 4, 1980

[54] JET RECIRCULATION METHOD FOR VACUUM CARBURIZING

[75] Inventors: James G. Conybear; Wallace J. Titus, both of Toledo, Ohio

[73] Assignee: Midland-Ross Corporation, Cleveland, Ohio

[21] Appl. No.: 935,491

[22] Filed: Aug. 21, 1978

[51] Int. Cl.[2] ..... C21D 1/48

[52] U.S. Cl. ..... 148/16.5; 266/44; 266/250; 266/251; 432/21; 432/199; 432/203

[58] Field of Search ..... 148/16.5, 16.6; 266/44, 266/250, 251, 254; 432/21, 23, 198, 199, 203

[56] References Cited

U.S. PATENT DOCUMENTS

| | | | |
|---|---|---|---|
| Re. 29,881 | 1/1979 | Westeren et al. | 148/16.5 |
| 3,128,323 | 4/1964 | Davis | 148/16.5 |
| 3,397,875 | 8/1968 | Davis | 148/16.5 |
| 3,796,615 | 3/1974 | Westeren et al. | 148/16.5 |

*Primary Examiner*—L. Dewayne Rutledge
*Assistant Examiner*—John P. Sheehan
*Attorney, Agent, or Firm*—Richard A. Negin

[57] ABSTRACT

A method and apparatus for recirculation of atmosphere in a vacuum furnace which comprises a recirculation loop in which there is a low pressure line from the furnace chamber leading to a recirculation pump which pumps the recycled gas at a higher pressure to a high pressure line back into the furnace chamber. A means to analyze the furnace atmosphere is in communication with the high pressure line and signals its measurements of the atmosphere analysis to a valve on an enriching line. The enriching line passes enriched gas into either the high pressure line or the furnace chamber as the valve opens or closes. A means is provided to withdraw the gas from the furnace chamber in order to maintain the desired furnace chamber pressure as enriching gas is added.

14 Claims, 2 Drawing Figures

JET RECIRCULATION METHOD FOR VACUUM CARBURIZING

BACKGROUND OF THE INVENTION

The invention is in the field of furnaces; more particularly, the invention relates to a jet recirculation system for use in vacuum furnaces, such as vacuum carburizing furnaces.

The method and apparatus of the present invention were developed and intended primarily for vacuum carburizing furnaces. However, the present invention can be used wherever modification to atmosphere composition and/or circulation of the atmosphere within the furnace heating chamber are desired. The invention is particularly useful in furnaces operating under a vacuum or very low pressures. It can be used in batch or multi-zone furnaces.

Apparatus and methods of carburizing are well known in the art. Gas carburization takes place in a furnace under a vacuum. When used with reference to the carburization process, the term vacuum implies that the furnace chamber is evacuated and carburizing gas, such as natural gas or methane and/or a carrier gas, such as an endothermic carrier gas, are then fed into a chamber which is held at less than atmospheric pressure. The carburizing gas contains a certain amount of carbon or has a carbon potential. The carbon from the gas is absorbed into the steel.

It is well known that to provide uniform carburizing within the workload, especially a workload of higher packing density, circulation of the atmosphere within the furnace chamber is necessary. This can be accomplished with a fan or with jets. In vacuum furnaces fans are impractical because such furnaces are designed for temperatures as high as 2400° F., where difficulties would be encountered in the material selection. Even at temperatures as low as 1700° F., the reduced pressures require that fans provide greater velocities than normal in conventional furnaces. Jets for use to circulate the furnace atmosphere have no restriction other than that sufficient gas be provided to satisfy flow requirements.

During the carburizing process, the composition of the gas changes. The concentration of the carbon bearing gases starts to decrease as they react to release their carbon. Additional amounts of gas are then needed to replenish the furnace atmosphere. The amount of additional gas needed had to be arrived at emperically by trial and error. The amount of gas needed, i.e. carbon demand, varies depending upon the amount of work charged and the composition of the furnace atmosphere. It has been difficult, if not impossible, to monitor and control the composition of the atmosphere because of the reduced pressure.

In the past, to solve the problems of circulation necessary for uniform vacuum carburization and replenishment of the carburizing gas, a fresh supply of gas was continuously supplied. To achieve the necessary atmosphere circulation, gas jets had to be operated at high velocities, and, therefore, an excessive amount of carburizing gas was necessary for satisfactory operation of the carburizing process.

U.S. Pat. No. 3,796,615 reissued as RE. 29,881 by Westeren discloses a method of vacuum carburizing by replenishing the carburizing gas and providing additional recirculation. In the method described by Westeren, the pressure and, therefore, the concentration of carburizing gas in the furnace chamber is carefully controlled. Carburizing gas is supplied to the furnace chamber by a plurality of inlets at predetermined intervals. Westeren alternately introduces a carburizing atmosphere into the heating chamber and then evacuates it at predetermined cycles. "This so-called pulsing affect tends to remove unwanted molecules of the carburizing environment from around the part being treated; and upon reintroduction of the carburizing atmosphere into the heating chamber after evacuation thereof, the carbon and the carburizing gas will be more readily absorbed into the article. Further, the pulsing affect produces a better distribution of carbon around the article, and in certain articles that are formed with irregular surfaces, the pulsing technique is provided and the carburizing cycle ensures that sufficient carbon will be diffused into the metal to produce the required result" (Westeren, column 5, lines 42–53).

U.S. Pat. No. 3,128,323 by Davis discloses a system for the measurement and control of the constituent potential of gaseous atmosphere and has for an object the provision of a method and apparatus for determining the carbon potential of an atmosphere of a carburizing furnace in which a sample stream thereof has a carbon potential beyond the range of the filamentary ferrous metal detecting elements used in the art. In order to do this, Davis pumps a sample stream from the furnace, through a flow meter and through the carbon measuring apparatus of his invention. Based on the measured carbon potential, means are provided for the addition of enriching material, or decarburizing material for alteration of the carbon potential. The means for adding decarburizing material has particular use in the multi-zoned furnace used to illustrate the Davis invention. Further, the method and apparatus of the Davis patent are pertinent to positive pressure furnaces rather than the vacuum furnaces of the present invention.

The Westeren patent requires the amount of carburizing gas to be determined in advance. Westeren states at column 6, line 34, "prior to the beginning of the operation of the furnace and the carburizing process, the operator preselects the number of pulses that will be required to produce a selected carburized case and will also select the period of time for each pulse." Westeren continues at column 6, line 43, "The absolute pressure or vacuum at which the carburizing cycle is performed is also preselected . . . "

Methods of the prior art have two main drawbacks. The first is that they cannot provide a continuous circulation over the wide temperature range used in vacuum carburizing furnaces, particularly at temperatures over 1700° F. without the introduction of excess gas. The second drawback is that in vacuum systems where gas is not continuously fed in for purposes of circulation, the amount of additional gas needed for carburization is arrived at emperically by trial and error and set in advance. This amount must vary depending upon the amount of work charged and the composition of the furnace atmosphere. Therefore, a need exists in the vacuum carburizing art for a method of continually monitoring the composition of the carburizing gas to determine the amount of gas used so as to be able to continually measure how far the carburization of the item treated has gone. Additionally, there is a need to provide circulation using a minimum of carburizing gas particularly when jets of carburizing gas are used as a circulation means.

SUMMARY OF THE INVENTION

The present invention in its most basic form is a method and apparatus for recirculation of atmosphere in a vacuum furnace which comprises a recirculation loop in which there is a low pressure line from the furnace chamber leading to a recirculation pump which pumps the recycled gas at a higher pressure to a high pressure line back into the furnace chamber. A means to analyze the furnace atmosphere is in communication with the high pressure line and signals its measurements of the atmosphere analysis to a valve on an enriching line. The enriching line passes enriched gas into either the high pressure line or the furnace chamber as the valve opens or closes. A means is provided to withdraw the gas from the furnace chamber in order to maintain the desired furnace chamber pressure as enriching gas is added. Heat exchangers can further be provided in the low pressure line to reduce the temperature of the atmosphere coming from the furnace. The atmosphere will then be at temperatures which are not detrimental to the recirculating pump and the gas analyzer. The gas analyzer will be analyzing gas at higher pressures preferably at normal atmospheric pressure. Therefore, the gas analyzer and any flow meters or pressure measuring devices in the high pressure line can be of the type commonly used at atmospheric pressure and need not be exotic measuring devices used at very low pressures.

The general object of the present invention is to provide a method and apparatus for recirculation of atmosphere in a vacuum furnace. More specifically, it is the object of the present invention to provide an apparatus for recirculation of an atmosphere in a vacuum carburizing furnace. Another object of the present invention is to provide a method and apparatus for circulation of the atmosphere within the furnace chamber. Another object of the present invention is to continually analyze the furnace atmosphere. Another object of the present invention is to continually enrich the carburizing atmosphere of the furnace as it is depleted of its carbon potential. It is another object of the present invention to provide a signal from the means to analyze the atmosphere to a valve in an enriching gas line so as to control the amount of enriching gas fed into the furnace chamber or into the high pressure line. It is a further object of the present invention to periodically withdraw gas from the furnace chamber to maintain the furnace pressure as enriching gas is added. Another object of the present invention is to provide heat exchangers in the low pressure line of the recirculation loop so that the temperature of the atmosphere being recirculated is reduced to prevent any damage to the recirculation pump, the atmosphere analyzer and any flow meters that might be downstream from the heat exchanger.

Other objects of the present invention include the saving of carburizing gas by only adding the amounts of enriching gas needed as the carburizing gas is used. It is further an object of the present invention to conserve energy by only adding cold enriching gas and lower temperature recirculating gas instead of having to either continually introduce new gas to maintain circulation or use the pulse method of Westeren where on each pulse the furnace is refilled with cold gas.

It is an object of this invention to obtain one or more of the objects set forth above. These and other objects and advantages of this invention will become apparent to those skilled in the art from the following specification and claims, reference being had to the attached drawings.

DESCRIPTION OF THE PREFERRED EMBODIMENTS

Figure 1:
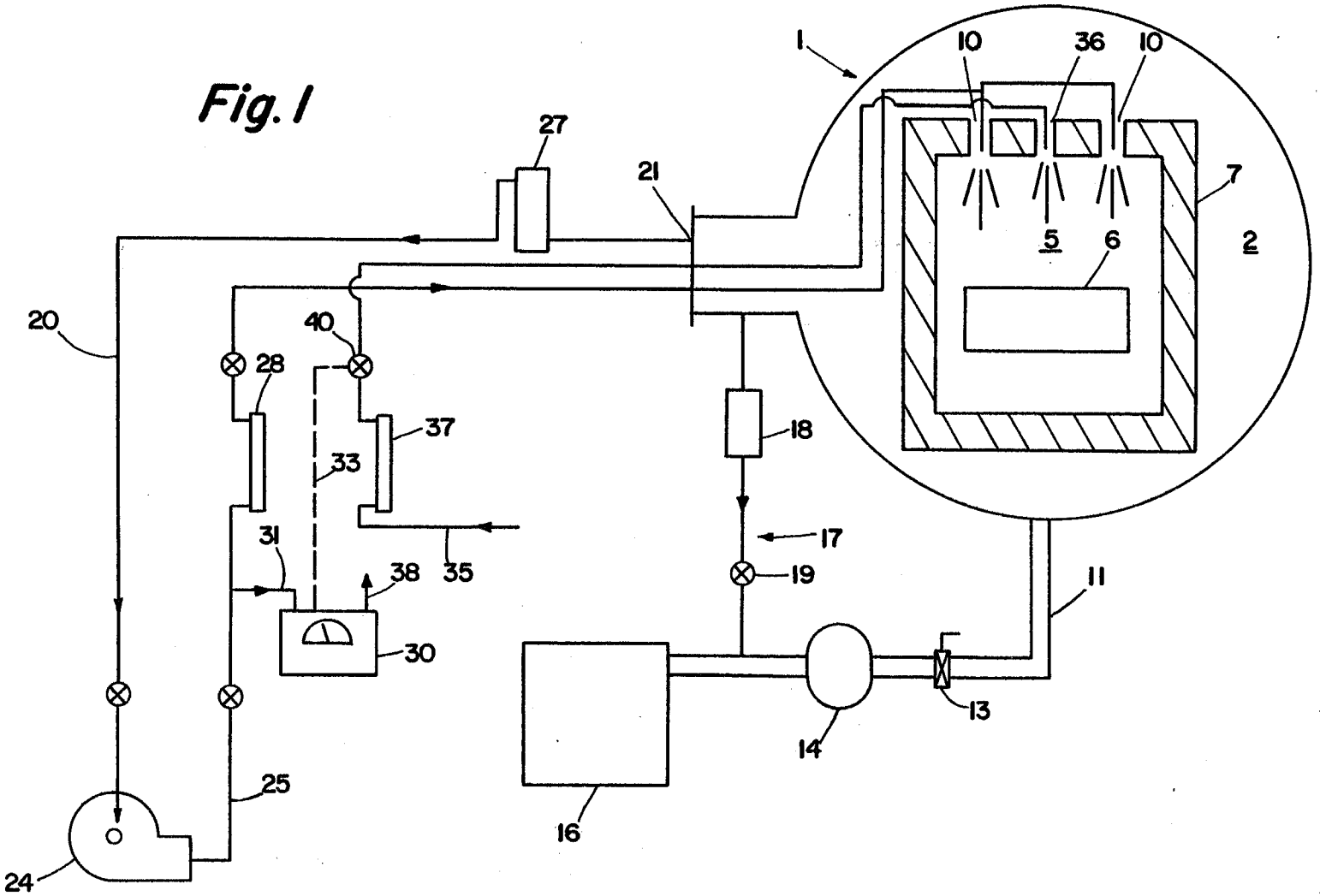
FIG. 1 is a schematic drawing of the jet recirculation system of the present invention used in a vacuum carburizer with enriching gas being fed directly into the furnace work chamber.
Figure 2:
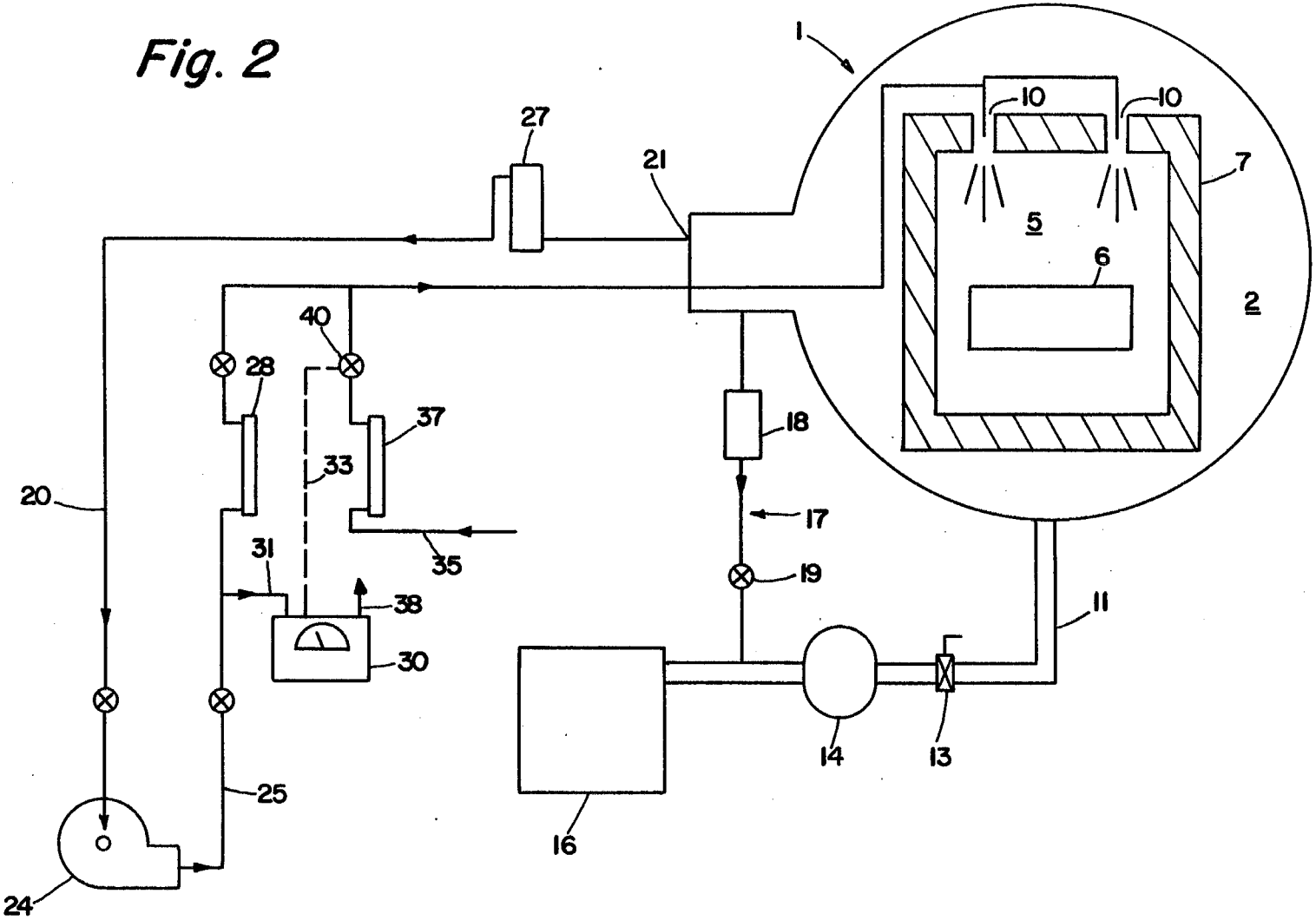
FIG. 2 is a schematic drawing of the jet recirculation system of the present invention used in vacuum carburizer with enriching gas being fed into the high pressure line.

The jet recirculation system of the present invention will be understood by those skilled in the art by having reference to FIGS. 1 and 2 showing a jet recirculation system used in a vacuum carburizing furnace. It can be used in both batch type and multi-zone furnaces. Many of the structural components necessary for the operation of a vacuum carburizing furnace known in the art but not particularly relating to the present invention are not shown.

Contained within vacuum furnace 1 is furnace chamber 2. Within furnace chamber 2 can be a work chamber 5 in which workload 6 is placed for treatment. The work chamber 5 has a walled enclosure 7. At least one gas jet inlet 10 passes through the walled enclosure 7. Although the embodiment described has a work chamber within a furnace chamber, a separate work chamber is unnecessary for the operation of the present invention.

The furnace chamber 2 has four gas lines in communication with it. Main line 11 in communication with the furnace chamber has a main furnace valve 13 and a high vacuum pump 14 disposed within it and it leads to a mechanical pump 16. A bypass line 17 communicates with the furnace chamber 2 and the main line 11 between the high vacuum pump 14 and the mechanical pump 16. Disposed within the bypass line can be a bypass heat exchanger 18 which will cool down any furnace gases passing from the furnace chamber to the pumps.

A low pressure line 20 passes from an outlet 21 in furnace chamber 2 to a recirculating pump 24. A high pressure line 25 passes from the recirculating pump 24 to at least one gas jet inlet 10 which passes through the walled enclosure 7 of the work chamber 5. Disposed within the low pressure line 20 can be a low pressure heat exchanger 27. Disposed within the high pressure line 25 can be a means to measure gas flow such as flow meter 28. A means to analyze atmosphere gas such as analyzer 30 is in communication with the high pressure line. A Beckman Infrared Methane Analyzer can be used. A suitable line of communication such as a communication tube 31 connects the atmosphere analyzer 30 with the high pressure line 25. The atmosphere analyzer 30 has a means to send a signal based on the analysis of the atmosphere (not shown). The signal is sent through signal line 33 to an automatic valve 40 in enriching line 35.

An enriching gas line 35 provides a conduit for an enriching gas such as methane. In the embodiment shown in FIG. 1, the enriching gas line goes from the source of enriching gas to enriching gas jet inlet 36 where it is fed into the work chamber 5. In the embodiment shown in FIG. 2, the enriching gas line feeds into the high pressure line 25. Disposed within the enriching gas line is a means to measure flow such as enriching gas line flow meter 37.

Pressure measuring means, as known in the art, are located within the furnace chamber 2 (not shown). The pressure measuring means has a means to signal a controller on a mechanical pump 16 so that it may pump atmosphere from the furnace chamber to maintain a set or desired pressure within the furnace chamber 2.

Method of Operation

The improved carburizing furnace of the present invention operates similarly to carburizing furnaces known in the art. The workload 6 is loaded into the work chamber 5 of the vacuum furnace. The furnace chamber 2 is evacuated roughly with the mechanical pump 16 and finally with high vacuum pump 14, and the workload 6 is heated by a suitable heating means (not shown) and soaked to ensure temperature uniformity. The furnace chamber 2 is then backfilled with a suitable carburizing gas such as natural gas to a preset carburizing pressure. At this time the recirculating pump of the present invention begins operating causing furnace atmosphere to be circulated from the furnace chamber 2 through low pressure line 20 in which can be disposed heat exchanging means such as heat exchanger 27. The atmosphere goes from the low pressure line 20 through the recirculating pump 24 into the high pressure line 25 where it is above the pressure in the vacuum furnace and preferably at atmospheric pressure. The atmosphere flows through the high pressure line to the gas jet inlets 10 of the walled enclosure 7 of the work chamber 5. The flow rate of the atmosphere within the high pressure line is measured by a flow measuring means such as flow meter 28 disposed within the high pressure line. An atmosphere analyzer 30 begins to analyze the atmosphere passing through the high pressure line 20. A sampling valve (not shown) in the communication tube 31 to the analyzer is opened and a gas sample passes from the high pressure line 25 through the analyzer 30 and out of the analyzer vent 38. The analyzer 30 sends a signal based on the analysis of the atmosphere to an automatic valve 40 in the enriching gas line 35. Enriching gas is added through the enriching gas line 35 as determined by the analyzer 30 controlling the automatic valve 40. The automatic valve 40 can be a variable or an on/off valve, both types of which are known in the art. The enriching gas line can pass enriching gas directly into the work chamber 5 of the vacuum furnace through an enriching gas jet inlet 36 as shown in FIG. 1 or directly into the high pressure line 25 as shown in FIG. 2. As the furnace pressure increases by the addition of enriching gas, gas is periodically removed from the furnace through bypass line 17 by opening the bypass solenoid valve 19 which is controlled by suitable pressure measuring and controlling means as known in the art (not shown) and pump atmosphere from the furnace until the desired pressure is reached.

At the end of the carburizing cycle, the recirculation system stops. The main furnace valve 13 is opened and the furnace is re-evacuated for the diffusion step. The method of carburization proceeds, as known in the art, through the steps of diffusion, cooling and quenching of the workload 6.

The method of the present invention provides an advancement over the art in that the furnace atmosphere is continually analyzed and replenished as needed. The means by which the furnace atmosphere is analyzed and controlled are of the type commonly used at atmospheric pressure and, therefore, problems associated with analysis, measurement and control of furnace atmosphere at very low pressures are avoided. Heat exchangers 27 and 18 the low pressure and the bypass line 17 reduce the furnace atmosphere temperature to temperatures which can easily be handled by the equipment downstream of them in the system. The gas jet manifold provides continuous circulation of the furnace atmosphere within the work chamber 5 using the furnace atmosphere itself as it is recycled plus necessary enriching gas as added to the system through the enriching gas line controlled by the furnace atmosphere analyzer and controller 30.

Therefore, the apparatus and method of the present invention provides savings of carburizing gas and energy. The savings of carburizing gas is accomplished because only additional enriching gas as needed is added to the system. The method of circulation of the furnace atmosphere in the work chamber provides a uniform carburization without the necessity of injecting additional amounts of carburizing gas only for the purpose of creating circulation within the work chamber 5. Energy is saved by the present invention in that additional amounts of cold gas to create circulation within the work chamber are not needed. The recirculating gas is cooled only enough so that the equipment within the recirculation line can withstand its temperature. The only cold gas added is the enriching gas which is only added as needed.

The advantages of the present invention can be illustrated by the following examples which compare the method of the present invention with that as used in the prior art.

In the first example test, parts consisting of 1 inch diameter × 6 inch long AISI 8620 steel bars were soldier located (stood vertically side by side with separation between them) in a work basket 24 × 36 inches, resulting in a net load of about 200 pounds. Identical loads were carburized with and without the recirculating system, at 1900° F. in a furnace having a heating chamber 24 inches wide × 36 inches long × 18 inches high.

Whether using the recirculating system or not, the furnace chamber is first backfilled to 300 Torr using methane. This step requires 9 standard cubic feet (SCF) of natural gas.

Without the recirculating system, it was necessary to introduce natural gas at a flow rate of 307 scfh for 26 minutes, resulting in a total natural gas consumption of 142 cubic feet. At the conclusion of the cycle, the furnace was evacuated to 100 microns (0.1 Torr) and the carbon allowed to diffuse, after which the load was quickly quenched to fix the carbon profile.

Using the recirculating system, a 25% methane concentration was maintained by the analyzer/controller by making periodic additions of natural gas to the recirculating stream. The control system maintained a constant atmosphere composition by adding natural gas at the rate of 133 scfh for 2 seconds in every 6 seconds, beginning 8 minutes after the start of the 26 minute carburizing time. This resulted in a total natural gas consumption of 13.3 cubic feet, or approximately 10% of that used in the cycle run without the recirculating system.

In another cycle identical to those above but having a test load of only five bars, it was found that only 9 cubic feet of gas was used when the recirculating system was operating. In all three cases, the results of carburizing were the same. The pieces were uniformly carburized to a total case depth (to 0.25% carbon) of 0.060 inches, and a surface carbon concentration of 1.0 weight percent.

It will be obvious to those skilled in the art that the construction and operation of the present invention can be applied to other furnaces and vacuum furnaces. Although the system was developed and intended primarily for carburizing, nitriding and carbonitriding, it could be used whenever modifications to the atmosphere composition and/or recirculation of the atmosphere within the hot chamber are desired. For example, instead of using a carburizing gas, hydrogen or even a metal halide to make the atmosphere more reducing or to provide for a means of coating the work pieces with protective coatings. Additionally the system could be modified by the addition of a heated gettering agent in the pressurized jet line to purify the atmosphere as it passes through the recirculation loop.

Modifications, changes and improvements to the preferred form of the invention herein disclosed, described and illustrated may occur to those skilled in the art to come to understand the principals and precepts thereof. Accordingly, the scope of the patent to be issued herein should not be limited to the particular embodiments of the invention set forth herein, but rather should be limited by the advance of which the invention has promoted the art.

What is claimed is:

1. An apparatus for recirculation of an atmosphere in a vacuum furnace having a furnace chamber, which comprises:
- a recirculation loop which further comprises:
  - a low pressure line;
  - an outlet from the furnace chamber to the low pressure line;
  - a recirculation pump of the type which will translate a low pressure inlet stream to a high pressure outlet stream, connected to the low pressure line;
  - a high pressure line passing from the recirculation pump;
  - at least one jet inlet to the furnace chamber, for continuously forcing recirculationg furnace atmosphere into the furnace chamber, from the high pressure line;
- a means to analyze the furnace atmosphere, connected to the high pressure line;
- an enriching gas line in communication with the furnace chamber;
- a means to periodically withdraw gas from the furnace chamber whereby the furnace pressure is maintained.

2. the apparatus as recited in claim 1 further comprising:
- a heat exchanger to cool the atmosphere coming from the furnace chamber, disposed in the low pressure line between the outlet and the recirculation pump;
- a means to signal based on the analysis of the atmosphere;
- a valve means within the enriching gas line controlled by the signal from the means to analyze.

3. The apparatus as recited in claim 1 wherein the enriching gas line is in communication with the furnace through an enriching jet inlet.

4. The apparatus as recited in claim 1 wherein the enriching gas line is in communication with the high pressure line at a location between the means to analyze and the jet inlet.

5. The apparatus as recited in claim 4 further comprising:
- a flowmeter disposed in the enriching gas line;
- a flowmeter disposed in the high pressure line between the means to analyze and the enriching gas line.

6. An apparatus for recirculation of an atmosphere in a vacuum carburizing furnace, having a furnace chamber within which there is a work chamber, which comprises:
- a recirculation loop which further comprises:
  - a low pressure line;
  - an outlet from the furnace chamber to the low pressure line;
  - a recirculation pump of the type which will translate a low pressure inlet stream to a high pressure outlet stream connected to the low pressure line;
  - a high pressure line passing from the recirculation pump;
  - at least one jet inlet to the work chamber, for continuously forcing recirculating furnace atmosphere into the work chamber, from the high pressure line;
  - a heat exchanger to cool the atmosphere coming from the furnace chamber, disposed in the low pressure line between the outlet and the recirculation pump;
- a means to analyze the furnace atmosphere connected to the high pressure line;
- a means to signal based on the analysis of the atmosphere;
- an enriching gas line in communication with the high pressure line at a location between the means to analyze and the jet inlet;
- a valve means within the enriching gas line controlled by the signal from the means to analyze;
- a means to periodically withdraw gas from the furnace chamber, whereby the furnace pressure is maintained.

7. A method for recirculation of an atmosphere in a vacuum furnace, having a furnace chamber and a recirculation loop with an inlet and outlet to the furnace chamber, which comprises:
- starting up a recirculation pump of the type which will translate a low pressure inlet stream to a high pressure outlet stream, disposed within the recirculation loop;
- drawing the atmosphere at a low pressure with the recirculation pump, from the furnace chamber, through a low pressure line, to the recirculation pump;
- pumping the atmosphere to a higher pressure from the recirculation pump through a high pressure line and then to jet inlets into the furnace chamber;
- continuously forcing recirculating atmosphere through the jet inlets into the furnace chamber to continuously circulate the atmosphere within the furnace chamber;
- analyzing the atmosphere with a means to analyze which is connected to the high pressure line;
- feeding enriching gas through an enriching line in communication with the furnace;
- withdrawing gas periodically from the furnace chamber to maintain the pressure in the furnace chamber.

8. The method as recited in claim 7 wherein the pressure in the furnace and the low pressure line is from about 10 to 600 Torr and the pressure in the high pressure line is above the pressure in the furnace.

9. The method as recited in claim 7 further comprising:

removing the heat from the atmosphere passing from the furnace chamber through the low pressure line with a heat exchanger means disposed in the low pressure line between the outlet and the recirculation pump;

sending a signal based on the analysis of the atmosphere to a valve within the enriching line;

controlling the valve within the enriching line by the signal from the means to analyze.

10. The method as recited in claim 7 further comprising the steps of:

measuring the flowrate of the atmosphere passing through the high pressure line;

measuring the flowrate of the enriching gas passing through the enriching gas line.

11. The method as recited in claim 7 wherein the enriching line communicates with the furnace chamber through the high pressure line.

12. A method for recirculation of an atmosphere in a vacuum carburizing furnace, having a furnace chamber within which there is a work chamber, and a recirculation loop which comprises:

starting up a recirculation pump of the type which will translate a low pressure inlet stream to a high pressure oulet stream, disposed within the recirculation loop;

drawing the atmosphere at a low pressure with the recirculation pump, from the furnace chamber, through a low pressure line, to the recirculation pump;

pumping the atmosphere to a higher pressure from the recirculation pump, through a high pressure line and then to jet inlets into the work chamber;

continuously forcing recirculating atmosphere through the jet inlets into the work chamber to continuously circulate the atmosphere within the furnace chamber;

removing the heat from the atmosphere passing from the furnace chamber through the low pressure line with a heat exchanger means disposed in the low pressure line between the outlet and the recirculation pump;

analyzing the atmosphere with a means to analyze which is connected to the high pressure line;

sending a signal based on the analysis of the atmosphere to a valve within an enriching line in communication with the high pressure line between the means to analyze and the jet inlets;

feeding enriching gas through the enriching line;

controlling the valve within the enriching line by the signal from the means to analyze;

withdrawing gas periodically from the furnace chamber, to maintain the pressure in the furnace chamber.

13. The method as recited in claim 12 wherein the pressure in the furnace and the low pressure line is from about 10 to 600 Torr and the pressure in the high pressure line is above the pressure in the furnace.

14. The method as recited in claim 13 wherein the pressure in the high pressure line is atmospheric pressure.

* * * * *

UNITED STATES PATENT AND TRADEMARK OFFICE

CERTIFICATE OF CORRECTION

PATENT NO. : 4,191,598

DATED : March 4, 1980

INVENTOR(S) : James G. Conybear and Wallace J. Titus

It is certified that error appears in the above–identified patent and that said Letters Patent are hereby corrected as shown below:

Column 6, line 5, after "low pressure" insert --line 20--;

Claim 1, line 43, "recirculationg" should be --recirculating--.

Column 5, line 37 "20" should be -- 25 --.

Signed and Sealed this

*Eighth* Day of *July 1980*

[SEAL]

*Attest:*

SIDNEY A. DIAMOND

*Attesting Officer*

*Commissioner of Patents and Trademarks*